United States Patent [19]

Belter et al.

[11] Patent Number: 4,545,096

[45] Date of Patent: Oct. 8, 1985

[54] FASTENER FOR WAISTBANDS OR THE LIKE

[75] Inventors: Lothar Belter; Alberto Stoecker, both of Wuppertal, Fed. Rep. of Germany

[73] Assignee: Schaeffer Scovill Verbindungstechnik GmbH, Wuppertal, Fed. Rep. of Germany

[21] Appl. No.: 473,913

[22] Filed: Mar. 10, 1983

[30] Foreign Application Priority Data

Apr. 24, 1982 [DE] Fed. Rep. of Germany ..... 3215470

[51] Int. Cl.[4] ..... A44B 19/00

[52] U.S. Cl. ..... 24/585; 24/68 R; 24/698

[58] Field of Search ..... 24/68 R, 68 SK, 69 R, 24/69 SK, 70 SK, 71 R, 71 SK, 387, 580, 584, 585, 599, 698

[56] References Cited

U.S. PATENT DOCUMENTS

| | | | |
|---|---|---|---|
| 1,680,652 | 8/1928 | Walinsky | 24/387 X |
| 1,702,674 | 2/1929 | Veneman | 24/580 X |
| 2,895,198 | 7/1959 | Stern | 24/68 R |
| 3,181,220 | 5/1965 | Mezerenyi | 24/698 X |
| 3,255,503 | 6/1966 | Sozzi | 24/387 |
| 3,988,812 | 11/1976 | Kanzaka | 24/585 |
| 4,180,891 | 1/1980 | Stocker | 24/68 R |
| 4,226,008 | 10/1980 | Kramer | 24/68 R |

FOREIGN PATENT DOCUMENTS

| | | | |
|---|---|---|---|
| 551839 | 1/1958 | Canada | 24/585 |
| 933381 | 9/1955 | Fed. Rep. of Germany | 24/585 |
| 2648377 | 4/1978 | Fed. Rep. of Germany | 24/387 |
| 2800288 | 7/1979 | Fed. Rep. of Germany | . |
| 1055919 | 2/1954 | France | 24/585 |

*Primary Examiner*—William E. Lyddane
*Assistant Examiner*—James R. Brittain
*Attorney, Agent, or Firm*—Gottlieb, Rackman & Reisman

[57] ABSTRACT

The fastener for waistbands on trousers or skirts has a detent rail fastened to one part of the waistband and a slide displaceable on the rail. The slide carries a pivotal lever which extends beyond its pivot axis into a detent projection. The slide or the lever is detachably connectable to the other part of the waistband. The other waistband part is provided on its inside with a hook which is engageable with an opening in either the slide or the lever. The opening is coordinated with a slide surface that facilitates this engagement even without looking. In this respect the slide surface is the outside surface of the lever, and it is located ahead of, with respect to the engagement direction, and lower than the opening.

7 Claims, 8 Drawing Figures

FASTENER FOR WAISTBANDS OR THE LIKE

The invention relates to a fastener for waistbands or the like, particularly on trousers, skirts or the like, having an adjustment rail which is fastened to one part of the waistband and on which there is a displaceable slide which carries a folding lever which extends beneath its pivot axis into a detent projection, and to which slide the other part of the waistband is detachably fastened.

One fastener of this type is known from FIG. 8 of German Federal Republic OS No. 28 00 288 wherein for the detachable fastening a claw plate is used. The plate is stamped out of the material of a folding lever, including holding projections which extend laterally above the plate. The stamped notches thereby produced form the path of insertion for the claw plate, which is connected with the other part of the waistband. In order to prevent accidental detachment as much as possible, the lever is bent into Z-shape, forming a grooved base. Although this development, in principle, permits the detachment of the other part of the waistband, it does not have widespread use since considerable skill is required in order to bring the claw plate into a position in which the holding projections are aligned with the notches. Also, to operate the fastener an unimpaired view is necessary which, however, is not present due to a cover strip which extends over the path of insertion. Furthermore, the folding lever must be initially swung out of its locked position since the claw plate is attached from the bottom side of the lever. The released slide may however shift during this operation.

The object of the present invention is to provide a fastener of the hook and eye type which, while of simple construction, permits more convenient operation, without the individual position of the slide being thereby changed.

In accordance with the invention the other waistband part (B) is provided on its inside (15) with a hook (16) which can be attached from the front side of the folding lever (2) into a window-shaped opening (17, 17'), and with which opening there is coordinated a slide surface (G) on the lever (2), which surface is located in front, as seen in the hooking direction (x), and lower than the web (18'', **18*a''*) of the opening, which web is hooked by the hook (16**).

As a result of this development, a fastener of this kind which is of increased value in use is obtained. Without changing the position of the folding lever, the other part of the waistband can be conveniently detached without visible connection, and be reattached, directly or indirectly, to the slide, which is reserved for fine adjustment. For this purpose a simple hook connection is used. The hook itself, which is hidden from sight, lies on the inside of the overlapping part of the waistband. It can be inserted from in front of the folding lever into the window-shaped opening. The folding lever therefore need no longer be swung out of the way and the outside surface of the lever, acting rather advantageously as a slide surface, arranged in front of the opening with respect to the direction of hooking engagement. Thus the folding lever has a double function. Since the corresponding slide surface is located lower than the hook web (18'' or **18*a''*) of the frame defining the opening, which web is hooked over by the hook (16), the window-shaped opening is also easily found by the user during the hooking operation. The hooking or unhooking can therefore be effected without looking or blindfolded. The hooking is effected in the opening (17 or 17'**) either on the slide or on the folding lever, respectively. Hooking to the folding lever would be preferable inasmuch as the pulling action can be used for the additional securing of the normal position of the lever. The other alternative has the advantage that the hooking can be effected on the free, outwardly bent end of a tab of the slide over which the folding lever which terminates slightly in front of the opening and the outside surface of which forms the slide surface, can be swung. By upwardly bending the portion forming the opening, the window-shaped opening is located transversely to the direction of insertion of the hook so as to favor catching. This and the other provision whereby the slide surface of the folding lever forms a guide groove optimize a functionally correct, and easily effected operation.

With the above and other objects and advantages in view, the present invention will become more clearly understood in connection with the detailed description of preferred embodiments, when considered with the accompanying drawings, of which:

The fastener of both embodiments, which is guided in carriage-like manner on a closely toothed engagement adjustment rail 1, has a folding lever 2 as well as a slide 3 on which the lever 2 is pivotally mounted.

Figure 1:
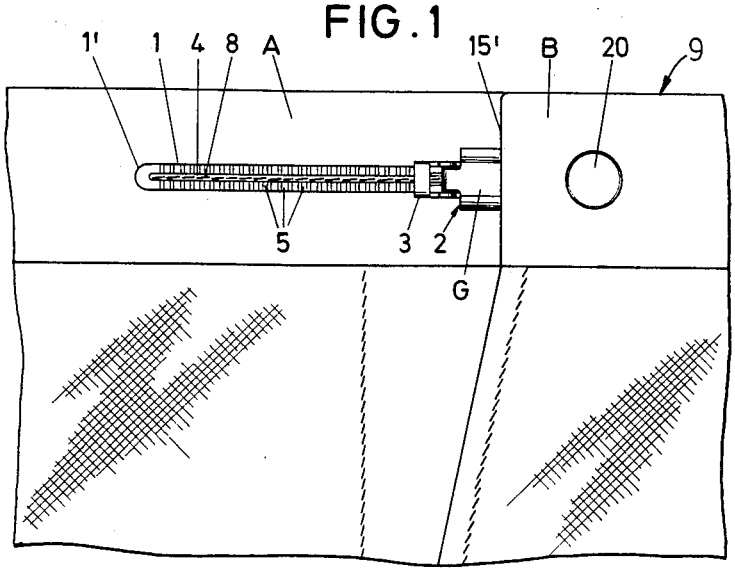
FIG. 1 shows the fastener of the invention in accordance with the first embodiment, applied to a trouser waistband.
Figure 3:
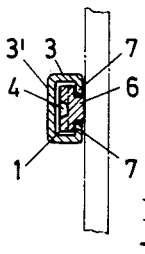
FIG. 3 is a cross-section along the line III—III of FIG. 2.
Figure 7:
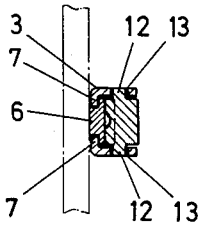
FIG. 7 is a section along the line VII—VII of FIG. 6.
Figure 8:
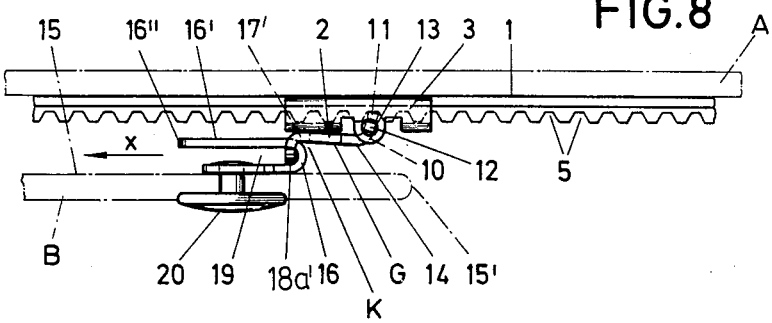
FIG. 8 is a side view of FIG. 6.

The teeth of the adjustment rail 1 form transverse detent depressions 5 divided by a centrally extending sewing depression 4 and a narrowed rail base 6 (see FIGS. 3 and 7). The rail is sewed through these sections fixedly attached to one part A of the waistband 9. The slide 3 forms a C-shaped cross-section which surrounds the adjustment rail 1. The arms of the C-shaped cross-section are bent twice, starting from a top or web 3' of the slide 3 such that by means of guide lugs 7, the arms engage behind the rear edges of the adjustment rail 1. After sewing the adjustment rail to the part A of the waistband using a central seam 8, the slide 3 is pushed on. This can be done from a free transversely rounded end 1' of the adjustment rail 1. The adjustment rail 1 holds the fastener fast to the waistband part A of the trouser waistband 9.

The folding lever 2 is bent transversely to the direction of travel of the slide 3. The lever is a two arm lever forming two legs 10, 14 bent at an angle relative to each other. The legs of the lever 2 are of different length. At its free end the shorter leg 10 of the lever points to the rail 1 and forms a detent projection 11 at its free end. The detent projection 11 cooperates with the detent depressions 5 for locking the slide at a position on the rail 1. Within the region of the seam 8, the detent projection 11 is cut back somewhat in order to protect the seam.

Figure 2:
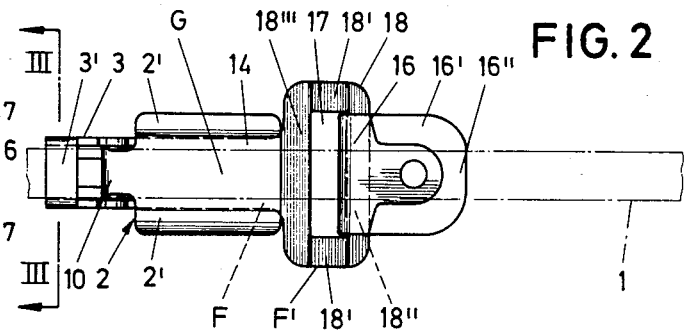
FIG. 2 shows the fastener in plan view, on a larger scale than in FIG. 1, with the adjustment rail indicated in dashed line.
Figure 4:
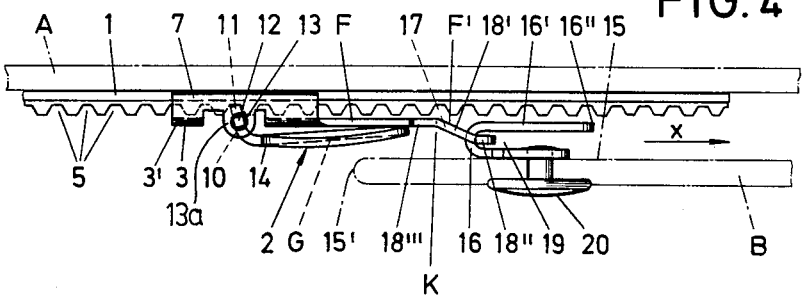
FIG. 4 is a side view of FIG. 2.
Figure 5:
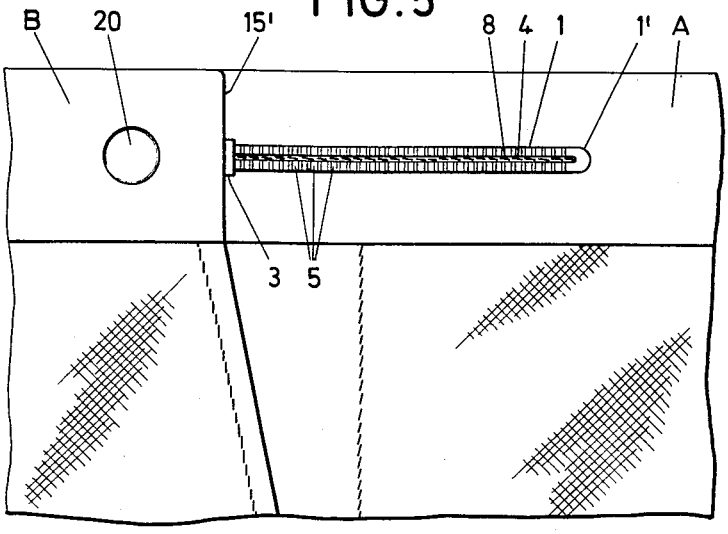
FIG. 5 is a view corresponding to FIG. 1 of the fastener in accordance with the second embodiment.
Figure 6:
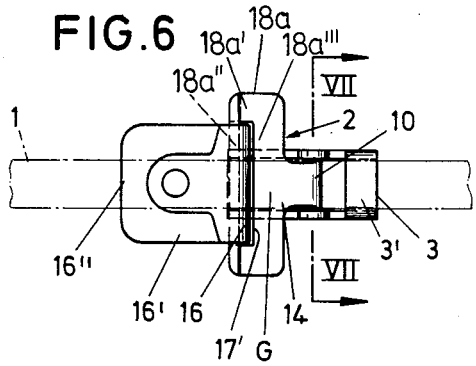
FIG. 6 is a plan view of FIG. 5 on a larger scale.

Furthermore, upon manufacture when the folding lever 2 is stamped out, two aligned projections 12 are formed on the lever 2 at the sides centrally on the shorter leg 10. These projections 12 form a pivot axis for the folding lever 2. In this respect each of the projections 12 extends into a bearing hole 13 in support lugs 13*a* of the slide 3. These lugs 13*a* are formed at opposite sides of the slide and are cut out of the material of the arms of the C-shaped cross-section of the slide 3. In mounting the folding lever 2 the support lugs 13*a* are spread slightly. After the pivot projections 12 are aligned with the bearing holes 13 the support lugs are pressed back again into their parallel position as shown in FIGS. 2 and 6. The folding lever 2 is thus pivotally secured to the slide 3.

From the angle vertex between the angled legs 10, 14 of the lever 2, this vertex being located outwardly of the projections 12, the shorter leg 10 of the angled shape folding lever 2 extends into the longer angle leg 14 of the lever. In the clamped position of the slide 3, the longer angle leg 14, which forms the actuating handle, extends substantially in the same direction as the direction of the rail 1 or the cover 3' of the slide 3 which extends parallel thereto.

The other part B of the waistband 9 is detachably fastened to the waistband part A. The other part B of the waistband 9 for this purpose has secured thereto a hook 16 on its inner side 15, and therefore the side which is out of direct view. The hook 16 can be inserted from the front of the lever 2 into a window-shaped opening 17.

In the embodiment shown in FIGS. 1 to 4, the window-shaped opening 17 is formed in the slide 3. A cover part F of the slide 3 is elongated in the direction of attachment to the hook 16 by an amount equal approximately to the dimension of the actual carriage portion of the slide. The cover part of the slide 3 extends as a freely floating tab F over the rail 1 and forms, at the end F' thereof, a long rectangular frame 18. The longer side of the rectangle lies transverse to the length of the rail 1. The frame 18 is of a greater width than the cover 3' of the slide 3 and also of greater width than the longer angle leg 14 of the lever 2 which forms the handle. The outer corners of the frame 18 are rounded.

In order to obtain, on the one hand, a sufficient spacing of the rail 1 from the hook leg 16' without contact and on the other hand to permit entry of the hook 16 into the window-shaped opening 17 which corresponds to the length of the waistband part B, the free end F' of the tab F is bent upwardly. In the embodiment of FIGS. 1 to 4 the bend extends only to the regions of the shorter frame arm 18', so that the higher frame arm or opening arm 18'', which is hooked over by the hook 16, and the frame arm 18''' which is at the same level as the cover 3' retain their position parallel to the adjustment rail 1. The hook 16, i.e. its hook leg 16', due to this and due to the relatively narrow hook jaw 19, is held sufficiently spaced from the rail 1.

The transverse position of the tab end F' which forms the window-like openng 17 and lever 2 which is arranged directly in front of the opening 17 are conducive to effecting engagement of the hook 16 in the opening 17, without looking, as the face of the folding lever 2 forms a guide, slide surface G, lying in the hooking direction x to aid in alignment of the hook 16 with the opening 17. This slide surface G is located lower than the web 18'', of the opening, which is hooked by the hook. Between the slide surface G and the adjoining angularly ascending (about 30° to 90°) tab F which has the window-shaped opening 17 a sloping throat K is produced in both embodiments. Thus engagement of the hook 16 in the opening 17 can be accomplished blindfolded.

The slide surface G of the hinged lever 2 is developed as a guide groove, as shown in FIG. 2, with longitudinal edge portions in the direction of the rail being formed as edge beads 2' which projects above the slide surface G. The beads 2' extend parallel to each other, but can also converge in the direction of the window-shaped opening 17, as a result of which an advantageous centering is obtained. The free end of the hook leg 16' is shaped by transverse rounding of its two corners, and if desired, a further tapering, into the shape of a guide projection 16''.

The fastening of the hook 16 to the other waistband part B can be effected by claws or, as in the preferred embodiment, by means of a rivet 20.

The region of attachment of the rivet 20 is located far enough on the inside 15 from the end 15' of the waistband that the section of the waistband extending on the slide side of the rivet 20 extends at least over the free end of the folding lever 2 in a covering and protective manner (see FIGS. 1 and 4 and 5 and 8 respectively).

As can be noted from the second embodiment, the other waistband part B is provided, in this case also, on its inner side 15 with a hook 16 which can be attached from the front side of the folding lever 2 into the window-shaped opening 17' which, however, is formed now not in the slide 3 but directly in the folding lever 2. The free end of the folding lever 2 is formed into a frame 18*a* which extends over and beyond the width of the slide 3. The opening 17' is formed by the webs 18*a'*, 18*a''* and 18*a'''* of the frame 18*a*. The web 18*a''* of the opening 17 (also called the frame leg 18*a''*) which is hooked by the hook 16 is bent at a greater angle, namely by about 90°. In this manner also the above-mentioned sloping throat K is produced.

Since the pulling force of the other waistband part B acts in a direction which maintains the clamping position, a particularly effective fastener is obtained. Thus the entire range of the slide 3 is reached by a corresponding cover-like projection of the free end 15' of the waistband part B.

At the bend of the lever 2 in the direction away from the rail, there is the tab forming the window-shaped opening 17' such that about half the length of the narrower frame leg 18*a'* is included in the bend. The width of the arm 18*a''* of the opening, which is now no longer parallel to the direction of the rail 1 but perpendicular thereto, corresponds to the width of the hook opening 19.

The waistband part B can be detached completely from the waistband part A or fastened and locked thereon in a jiffy.

Herein the word "folding" with respect to "folding lever" means that the lever can fold-over into its normal position of FIGS. 3–4 and 6–7 or it can be pivoted out of this position, i.e., it is pivotal.

We claim:

1. In a hook and eye type fastener for a garment waistband having an underlying part and an overlying part, wherein the eye portion of the fastener is carried by a slide displaceably secured to an adjustment rail fastened to one of said parts and the hook portion is secured to the other of said parts, and wherein the eye portion includes a first member provided with a window opening bounded at an end of said first member by a transverse web, and the hook portion includes a second member constituting a hook and being of substantially U-shaped form, with one leg of the hook lying against and being secured to said other part of the waistband, the other leg of the hook being spaced from and extending along said one leg to terminate in a free end edge, and the bend of the hook being directed toward the slide so as to enable said other leg of said hook to be inserted into and through said window opening for causing the hook to be hooked over said transverse web of said first member, and wherein said slide carries a two-ended folding lever which is pivoted adjacent one of its ends to the slide on the side of the latter facing away from said adjustment rail, with the folding lever having a top side and an underside of which the latter faces said adjustment rail and said slide when said folding lever is pivoted into overlying relation to the slide, and with the folding lever further having a projection extending generally perpendicularly from its underside and formed as a detent adapted to releasably tightly engage said adjustment rail and immobilize said slide thereon when said folding lever is pivoted into said overlying relation to said slide;

the improvement comprising that:

(a) said first member is constructed to dispose said transverse web at a greater distance from said adjustment rail than substantially the entire expanse of said window opening, and (b) said top side of said folding lever defines a guide surface which has a first end region proximate to said one end of said folding lever and a second end region proximate to the other end of said folding lever, said guide surface, when said folding lever is in said overlying relation to said slide, sloping from said first to said second end region thereof in a manner to dispose said second end region of said guide surface (i) proximate to the end of said window opening remote from said transverse web of said first member and (ii) at a smaller distance from said adjustment rail than said transverse web, (c) said guide surface being engageable by said free end edge of said other leg of the hook to enable that edge to be slid along said guide surface so as to enter said window opening and pass between said transverse web and said adjustment rail without any displacement of said folding lever out of said overlying relation thereof to said slide.

2. In a fastener according to claim 1, the improvement comprising that:

said slide has an extension constituting said first member and forming a tab with a free end portion, said window opening being formed at least partially in said free end portion of said tab, said transverse web of said first member being located at the extremity of said free end portion of said tab, and said free end portion of said tab being slanted relative to said slide, and said free end portion of said tab being slanted relative to said slide to dispose the end of said window opening remote from said transverse web closer to said adjustment rail than said transverse web, and said folding lever is constructed and arranged, when in said overlying relation to said slide, to dispose said second end region of said guide surface over a portion of said tab bounding said window opening at said end thereof remote from said transverse web to permit the movement of the hook along said guide surface into said window opening.

3. In a fastener according to claim 2, the improvement comprising that:

said folding lever is provided at said top side thereof with a pair of lateral ribs constituting the lateral boundaries of said guide surface, the latter and said ribs defining a guide groove for guiding the movement of said other leg of said hook into said window opening.

4. In a fastener according to claim 1, the improvement comprising that:

said folding lever constitutes said first member and said window opening is formed at least partially in a free end portion of said folding lever having said transverse web at the extremity of said folding lever, said guide surface extending up to said window opening to permit the movement of said other leg of said hook along said guide surface into said window opening, said hook when hooked over said transverse web exerting a longitudinal force on said folding lever tending to retain the same in said overlying relation to-said slide.

5. In a fastener according to claim 4, the improvement comprising that:

said folding lever is provided at said top side thereof with a pair of lateral ribs constituting the lateral boundaries of said guide surface, the latter and said ribs defining a guide groove for guiding the movement of said other leg of said hook into said window opening.

6. In a fastener according to claim 1, the improvement comprising that:

said folding lever is said first member, said window opening being formed in said folding lever.

7. In a fastener according to claim 1, the improvement comprising that:

an adjunct of said slide is said first member, said window opening being formed in said adjunct of said slide.

* * * * *